US007699762B2

(12) United States Patent
Turnbull et al.

(10) Patent No.: US 7,699,762 B2
(45) **Date of Patent: *Apr. 20, 2010**

(54) EXERCISE SYSTEM FOR USE WITHIN A VEHICLE

(76) Inventors: R. Gary Turnbull, 2901 Sesame St., Howell, MI (US) 48843; Bryan S. Turnbull, 6420 92nd Pl., #1206, Pinellas Park, FL (US) 33781

( * ) Notice: Subject to any disclaimer, the term of this patent is extended or adjusted under 35 U.S.C. 154(b) by 0 days.

This patent is subject to a terminal disclaimer.

(21) Appl. No.: 11/063,349

(22) Filed: Feb. 23, 2005

(65) Prior Publication Data

US 2005/0143231 A1 Jun. 30, 2005

Related U.S. Application Data

(63) Continuation-in-part of application No. 10/617,996, filed on Jul. 11, 2003, now Pat. No. 7,229,392.

(51) Int. Cl.
*A63B 21/04* (2006.01)

(52) U.S. Cl. ..... 482/130; 482/904

(58) Field of Classification Search ..... 482/121, 482/129–130, 142, 904, 907
See application file for complete search history.

(56) References Cited

U.S. PATENT DOCUMENTS

| | | | | |
|---|---|---|---|---|
| 1,973,945 | A * | 9/1934 | Chavin et al. | 482/130 |
| 3,751,033 | A | 8/1973 | Rosenthal | 482/60 |
| 4,241,914 | A | 12/1980 | Bushnell | 482/130 |
| 5,013,035 | A | 5/1991 | Nathaniel | 482/129 |
| 5,090,694 | A * | 2/1992 | Pauls et al. | 482/118 |
| 5,171,198 | A | 12/1992 | Jones | 482/97 |
| 5,234,394 | A | 8/1993 | Wilkinson | 482/92 |
| 5,558,608 | A | 9/1996 | Hall | 482/129 |
| 5,667,267 | A * | 9/1997 | Talucci | 296/26.15 |
| 5,743,838 | A | 4/1998 | Willis | 482/124 |
| 5,899,836 | A * | 5/1999 | Chen | 482/92 |
| 6,159,133 | A * | 12/2000 | Shugg | 482/130 |
| 6,183,403 | B1 | 2/2001 | Dunn | 482/121 |
| 6,210,306 | B1 * | 4/2001 | Miller | 482/54 |
| 6,261,213 | B1 | 7/2001 | Frey | 482/121 |

(Continued)

OTHER PUBLICATIONS

Hane, John, Newsday, Fitness File/No. excuses/No time to get to the gym? The Sandman will bring it to you., Nov. 22, 1999, p. B13.

(Continued)

*Primary Examiner*—Fenn C Mathew
(74) *Attorney, Agent, or Firm*—Gifford, Krass, Sprinkle, Anderson & Citkowski, P.C.

(57) ABSTRACT

An exercise system for use in a vehicle includes a frame that has a pair of spaced apart base members. Support legs extend from each base member and a crossbeam is connected to and extends between each support leg. Mounting fixtures are positioned on each support leg and on each base member. Additionally, one or more exercise devices may be removably secured to each mounting fixture. In operation a user may attach an exercise device to the frame and undertake resistance exercises for the arms, legs and torso. Various sized individuals at various strength levels can be accommodated via altering the resistance of the exercise device.

11 Claims, 6 Drawing Sheets

U.S. PATENT DOCUMENTS

| | | | | |
|---|---|---|---|---|
| 6,368,260 | B1 * | 4/2002 | Crews | 482/142 |
| 6,500,104 | B1 * | 12/2002 | Rich | 482/123 |
| 6,692,414 | B1 | 2/2004 | Gelbart et al. | 482/112 |
| 7,229,392 | B2 * | 6/2007 | Turnbull et al. | 482/129 |
| 2002/0025890 | A1 | 2/2002 | Keiser | 482/92 |
| 2002/0107119 | A1 | 8/2002 | Porter | 482/121 |

OTHER PUBLICATIONS

Location Fitness, Location Fitness Keeps Stars in Shape With on Location Fitness Centers, May 12, 1999, locationfitness.com web page from Jan. 19, 2005.

* cited by examiner

EXERCISE SYSTEM FOR USE WITHIN A VEHICLE

RELATED APPLICATION

The present application is a continuation-in-part of U.S. non-provisional patent application Ser. No. 10/617,996 filed Jul. 11, 2003.

BACKGROUND OF THE INVENTION

1. Field of the Invention

The present invention relates to personal exercise equipment designed for, although not limited to, use within motor vehicles, particularly, semi tractors, motor homes, buses and large recreational vehicles. Both driver and passenger seats are ideal locations, but the invention is positionable and may be used anywhere in a vehicle.

2. Description of Related Art

Twentieth century mankind has, through its own inventions, made exercising of the body through daily activity almost non-existent. At the same time, medical science has proven the paramount importance of physical exercise to human longevity and quality of life. We, mankind, have therefore invented hundreds of systems and apparatus to artificially or intentionally exercise the body.

Most of this exercise equipment is available to individuals by going to a physical location such as a gym or their own in-home workout location. There is, however, a large and quickly growing group of people who are, for the most part of their lives, mobile and thus unable to go to a fixed location to obtain exercise.

People who spend most or all of their day, and sometimes night, in vehicles are in great need of exercise. The benefits from the ability to safely exercise while seated in a vehicle, stopped or moving, are immeasurable, and are one reason for the present invention.

There have been a few devices created for exercise within vehicles, but all have significant shortcomings when compared to this invention.

U.S. Pat. No. 5,141,482 discusses a seat exercise device to be used specifically and exclusively for abdominal exercise in virtually one position. It further requires the attachment of a mechanism to the body as well as the chair or seat, making the device cumbersome to use and very limited in its scope of exercise.

U.S. Pat. No. 4,013,287 discusses a device that permanently attaches under the dashboard and offers a stirrup attached to a spring device for one to insert their foot in and extend the spring device thereby exercising one or several leg muscles. This device is again very limited in scope of exercise. Further, its location seems to pose a significant safety risk in that it hangs in the area where footwork is required to operate a vehicle.

U.S. Pat. No. 6,183,403 B1 discusses a vehicle exercise system consisting of two very separate parts. Part 1 allows arm use of an elastic member with the member's other end being secured by the upper portion of a vehicle doorjamb. This allows arm exercise, but primarily in a sideways fashion; and with a one-point attachment located above and off to the side of the exerciser, a very limited range of motion is achieved. Certainly, symmetrical exercise of both arms cannot be realized from this setup without changing seats and moving the apparatus to the opposite door. Further, when not exercising, the apparatus must be removed via opening the door. If not removed, it creates an unsafe distraction while dangling in front of the side window of the vehicle. Part 2 allows arm and leg use from an elastic length whose other end is attached to a belt that is attached to the seat. Having only two attachment points offered for the elastic mechanisms again results in a very limited range of exercise motion. Further, it appears that the connection points are free to slide along the length of the seat connection belt, which would result in the elastic members pinching against the exerciser's body when extended, causing discomfort. In addition, both parts of this invention appear to cause wear and likely damage to the vehicle components.

Accordingly, there is need in the art for an exercise system that provides balanced and symmetrical bodily exercise offering a large range of movement (muscles to be exercised), utilizing equipment that is out of the way and non-hazardous when not in use. The present invention accomplishes the above-cited requirements.

SUMMARY OF THE INVENTION

The invention is a new exercise system for use inside a vehicle. Larger vehicles are better suited to the invention, but it could be used in any vehicle. It is a system supplied in easy-to-assemble components to facilitate handling, shipping and assembly to the vehicle, although it could also be produced as one solid frame without affecting performance of the invention. It is a portable, lightweight system that requires a semi-permanent attachment to the vehicle prior to use. Once mounted, it is intended to stay in place for long periods, being removed only for long term discontinuance of use or reassignment to another vehicle.

The system includes a frame of suitable material, most often metal, that is mounted to the floor of the vehicle along each side of a seat through the use of fasteners such as self-tapping metal screws. The frame, when used in conjunction with a seat, is positioned such that the two support legs at the rear of the base members rise alongside of and slightly behind the seat back. The support legs are joined at the top with an adjustable but rigid crossbeam spanning the width between the support legs across the back of the seat but not connected to the seat in any fashion. The base member, support arms and crossbeams all have eyelet type mounting fixtures permanently attached (although not necessarily) and strategically positioned for attachment of elastic, resistance exercise bands, springs or tubes. In addition, the support arms can rotate so that exercises can be done while standing behind the seat. The elastic members have handles on one end capable of being repositioned along the band length, but not necessarily so. The other end of the elastic member is permanently attached, although not necessarily so, to a snap hook device used to affix the elastic member to the framework discussed earlier. A myriad of at least thirty different exercises (affecting different muscle groups) are achieved via matching different bodily movements with different anchoring positions on the framework. Various sized individuals at various strength levels can be accommodated via altering the resistance of the elastic member through substitution of a different member and by altering the length between the attachment end and the handle end with a quick release handle, although not necessarily through the use of a quick release handle.

It is an object of this invention to provide an exercise system that is substantial and yet unobtrusive enough to leave permanently positioned in a vehicle and ready for use at any time.

It is an object of this invention to provide an exercise system that will provide its user with a complete body workout, as understood by common exercise practitioners, all while sitting in the vehicle seat or standing or sitting behind the seat.

It is an object of this invention to positively affect the health of individuals who earn their living by or otherwise are so engaged as to spend large amounts of time in their vehicles.

It is an object of this invention to make the invention have universal application through a general built-in flexibility of assembly and installation.

It is an object of this invention to make it inexpensive, lightweight and easy to use.

It is an object of this invention to be able to evolve with the exerciser as the exerciser gains strength and stamina, thereby still being an effective tool for the exerciser.

BRIEF DESCRIPTION OF THE DRAWING

A better understanding of the present invention will be had upon reference to the attached drawings wherein like reference numerals refer to like parts throughout and wherein.

DETAILED DESCRIPTION OF THE PREFERRED EMBODIMENTS

Figure 1:
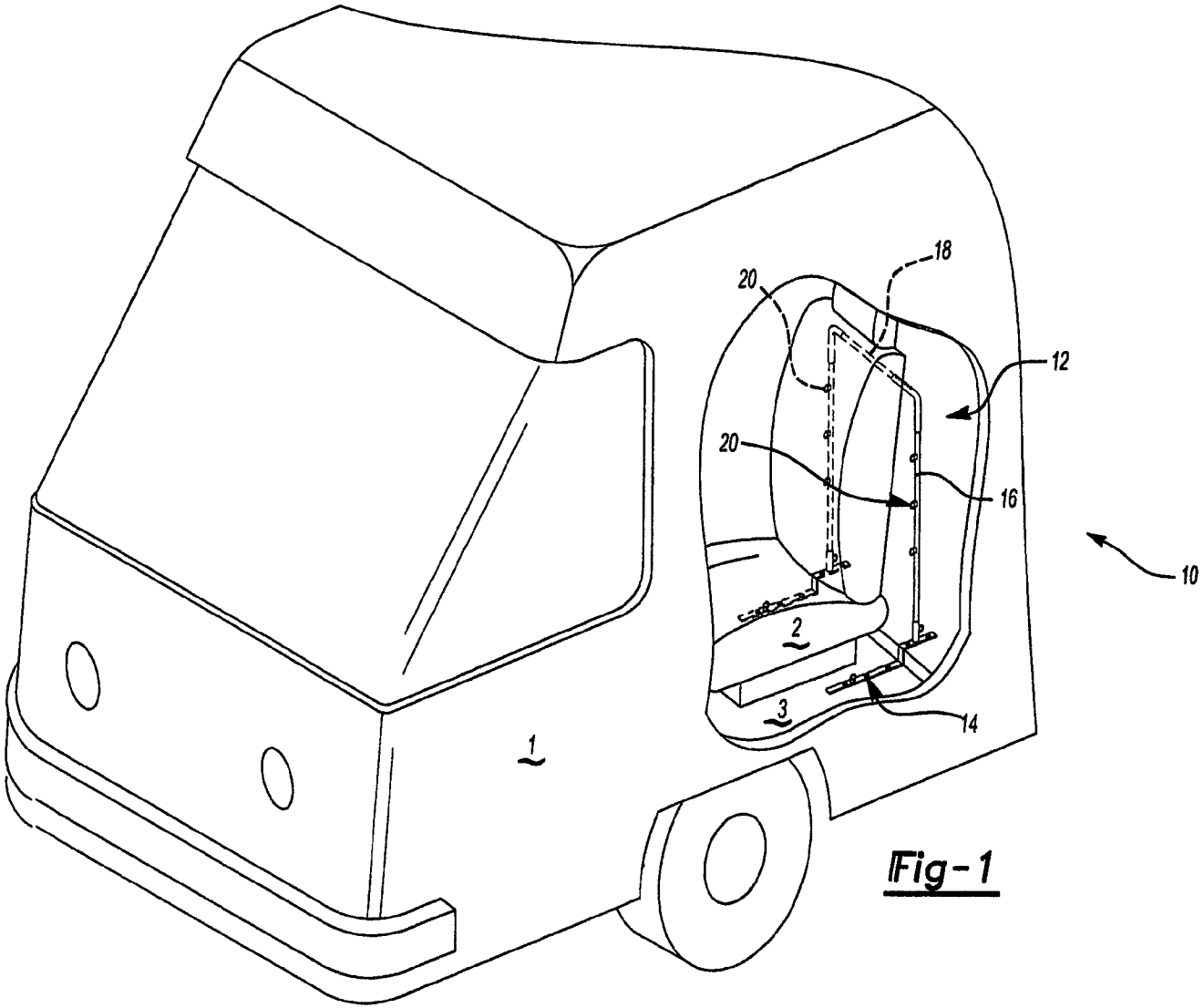
FIG. 1 is an environmental perspective view showing an environmental perspective view of an exercise apparatus constructed in accordance with the present invention positioned in a vehicle.

Referring now to FIGS. 1-3E, the present invention includes an exercise system 10 for use within a vehicle 1. The exercise system 10 has a frame 12 that includes a pair of spaced apart base members 14, support legs 16 that extend from each base member, and a crossbeam 18 that is connected to and extends between each support leg 16. Mounting fixtures 20 are positioned on each support leg 16 and on each base member 14. One or more exercise devices 22 may be removably secured to each mounting fixture 20.

Figure 2:
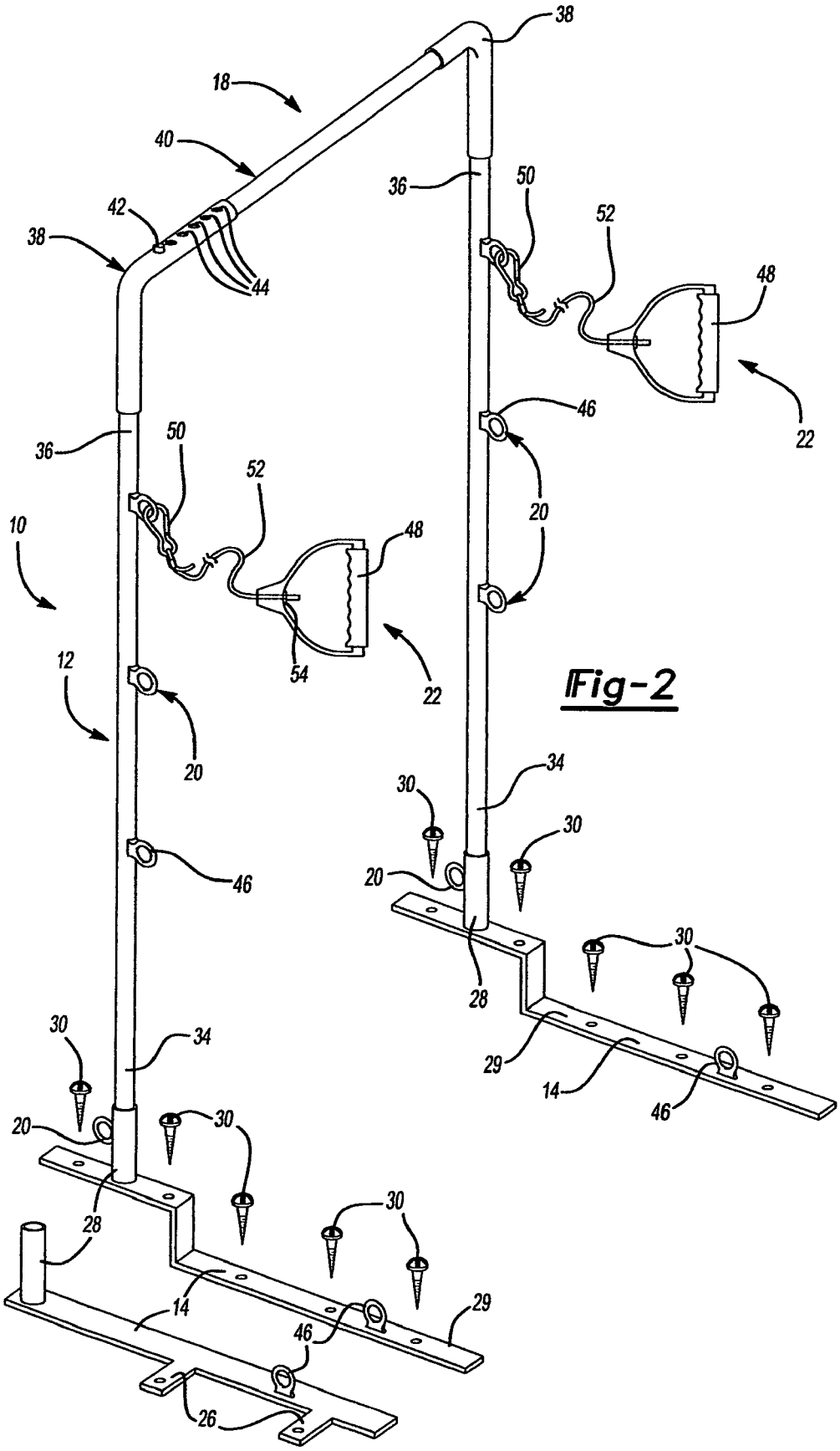
FIG. 2 is a perspective view of the exercise apparatus.

Referring now to FIGS. 1 and 2, the frame 12 is preferably constructed from rigid and strong materials. For example, the frame 12 may be constructed of steel rods or carbon fiber tubes. However, other materials may also be used that meet the requisite strength and rigidity requirements. It will also be appreciated that the frame 12 may be constructed in separate sections or as one integral unit. As shown in the drawings, the frame 12 may be positioned beside or to the rear of a vehicle seat 2. Alternatively, the frame 12 may be positioned anywhere in a vehicle.

Still referring to FIGS. 1 and 2, the base members 14 of the frame 12 are constructed as elongated bars 24. As best shown in FIG. 2, each base member may also alternatively include a pair of flanges 26 that extend perpendicular to the longitudinal axis of the bars 24. A sleeve 28 is positioned on and extends away from a top surface 29 of each base member 14. Each base member 14 is secured to a floor 3 of the vehicle 1 by fasteners 30. The fasteners 30 may include self-tapping metal screws 32, hook-and-loop fasteners (e.g., VELCRO®) or an adhesive. As again best shown in FIG. 2, the bottom 33 or contact surface of each base member 14 may be stepped or have some other shape that is complementary to the floor 3 of the vehicle. Accordingly, the base member 14 may be a planar member or may be contoured in order to conform to the floor 3 of the vehicle 1.

Each support leg 16 of the frame 12 is preferably constructed as an elongated rod having one end 34 that is adapted to engage the sleeve 28 of the base member 14 and an opposite end 36 that is engaged by the crossbeam 18. The support legs 16 may be rotatable in the sleeves 28 such that the user may orient the mounting fixtures 20 in a predetermined direction. Accordingly, the exercise system 10 of the present invention may be used by a person sitting in the seat 2 or by a person positioned behind the seat 2.

The crossbeam 18 of the frame 12 engages and extends between the opposite ends 36 of each support leg 16. Specifically, the crossbeam 18 may include a pair of elbow sleeves 38 that engage the ends 36 of the support legs 16 and a bar 40 that extends between the sleeves 38. As best shown in FIG. 2, the frame 12 may be adjusted by the use of a spring biased pin 42 and aperture 44 arrangement associated with bar 40 and one of the elbow sleeves 38, respectively, of the crossbeam 18. Alternatively, the crossbeam 18 could be constructed using a pair of telescoping tubes (not shown) as an alternative means for adjusting the frame 12.

Still referring to FIGS. 1 and 2, mounting fixtures 20 are positioned along each support leg 16 and on each base member 14. Preferably, the mounting fixtures 20 are eyelets 46 that extend from the legs 16 and the base members 14. Alternatively, the mounting fixtures 20 may be constructed as apertures in the legs 16 and base members 14.

Figure 3A:
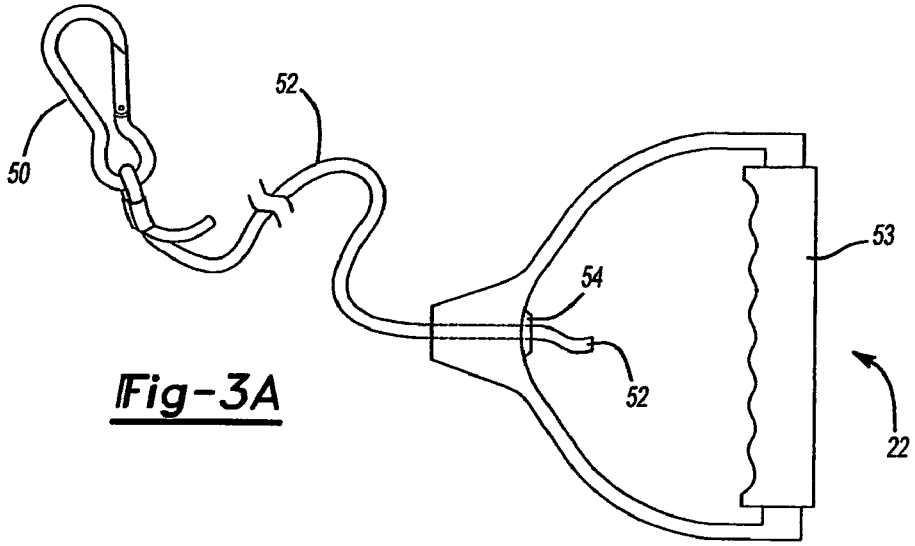
FIG. 3A is a perspective view showing an elastic cord secured to a grip by a grommet.
Figure 3B:
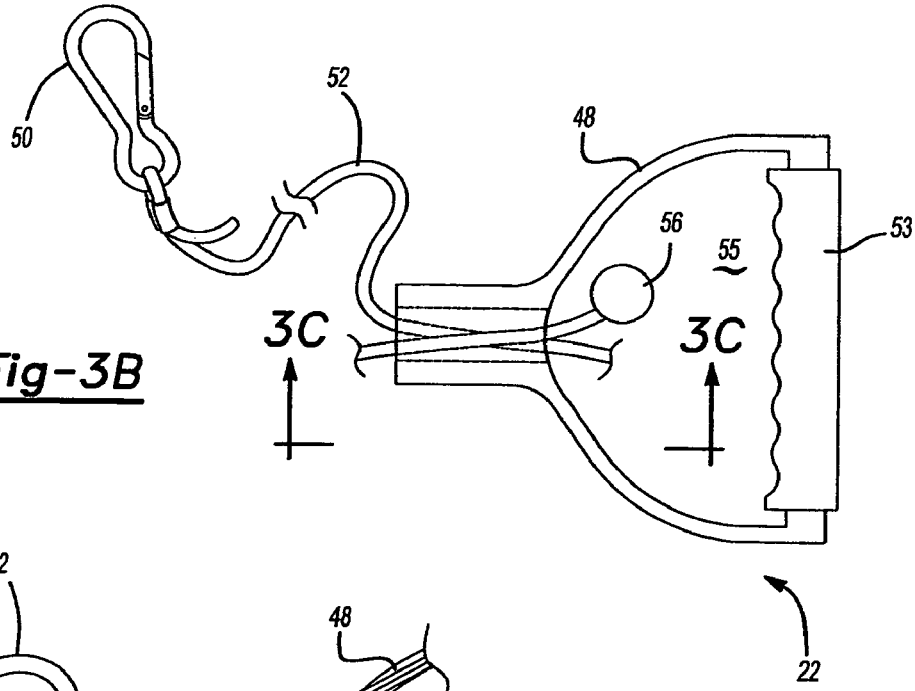
FIGS. 3B and C show an alternative means for securing the elastic cord to a grip.
Figure 3C:
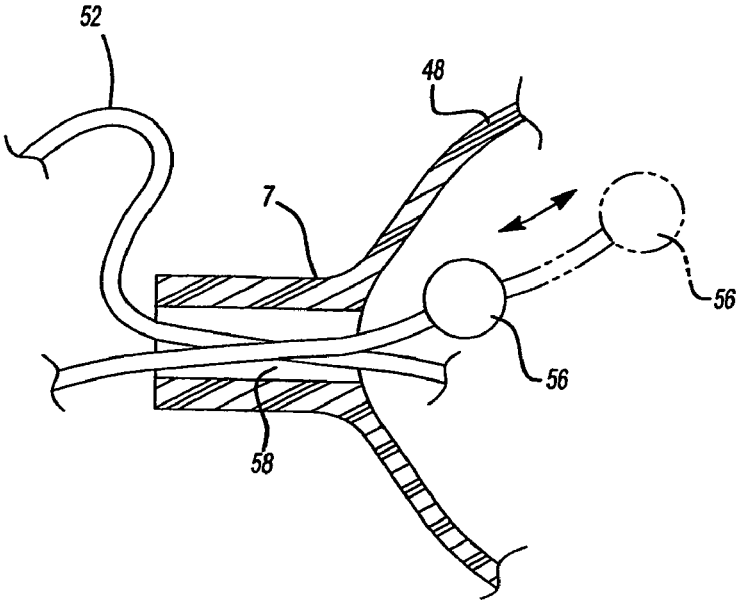
FIG. 3D is a perspective view of a clip for use in securing an elastic cord and grip to a frame of an exercise apparatus.
FIG. 3E is a perspective view of an elastic belt for use with the present invention.
FIG. 3F is a perspective view of an alternative embodiment of an elastic belt.
Figure 3D:
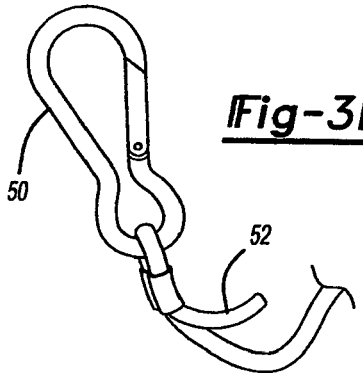

Referring now to FIGS. 2-3D, an exercise device 22 of the present invention may be constructed as a grip 48 that is secured to a clip 50 by an elastic cord 52. The clip 50 is removably securable to a mounting fixture 20 of the frame 14. As shown in FIG. 3A, the grip 48 may be constructed as a plastic handle having a grasping portion 53 and an open portion 55. The elastic cord 52 is secured to the handle by a grommet 54. Alternatively, as shown in FIGS. 3B-C, the elastic cord may be secured to the grip 48 by means of a ball 56 disposed at one end of the cord 52 with the cord 52 extending through an aperture 58 defined in the grip 48; the aperture having an inside diameter that is smaller than the diameter of the ball 56.

Figure 3E:
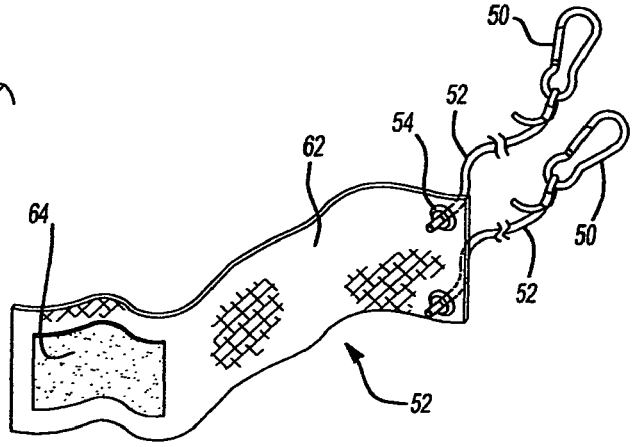

As shown in FIG. 3E, the exercise device 22 may also be constructed as a belt 60. Preferably, the belt 60 includes a pair of bands 62 that can be secured together by hook-and-loop fasteners 64 or the like with each band being connectable to the mounting fixtures 20 of the frame 12 by elastic cords 52 and clips 50 (as discussed above).

Figure 3F:
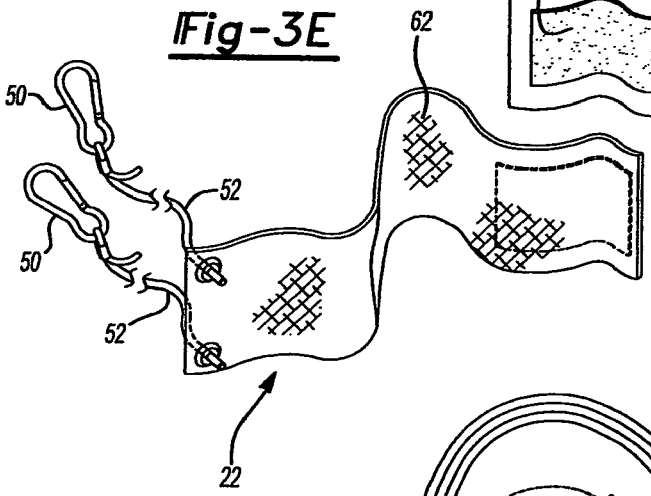
Figure 3F:
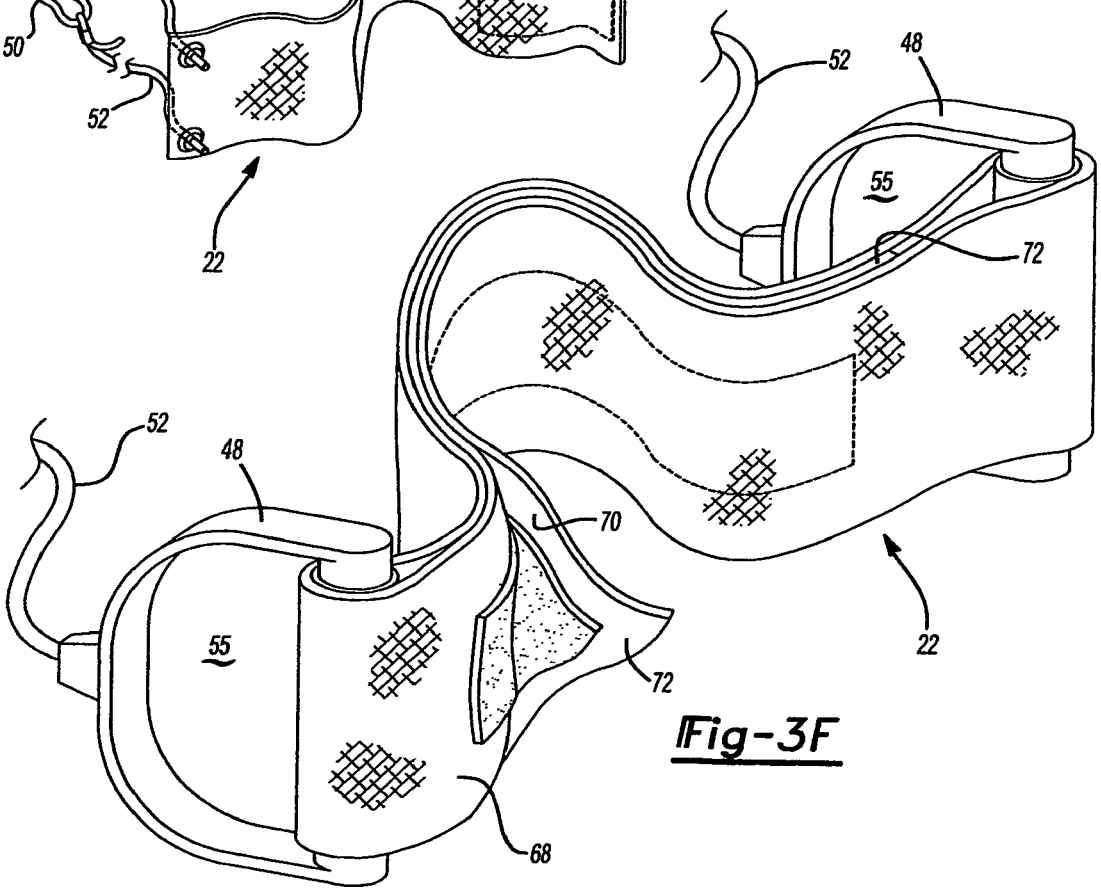

Referring now to FIG. 3F, there is shown an alternative belt 60' construction for the exercise device 22 of the present invention. In this embodiment, the belt 60' includes a length of material having hook-and-loop fasteners 64 positioned on opposite sides 68, 70 of the material, and particularly on the ends 72 of the material. Accordingly, the belt 60' is passed through the open portion 55 of a pair of grips 48 and secured together using the hook-and-loop fasteners 64. By placing the belt 60, 60' across the chest or around an ankle, a user is able to exercise a range of different muscle groups.

In operation, a user may attach an exercise device 22 to the frame 12 and undertake resistance exercises for the arms, legs and torso. Indeed, at least thirty different exercises (affecting different muscle groups) may be achieved via matching different bodily movements with different mounting fixtures 20 on the frame 14. Various sized individuals at various strength levels can be accommodated via altering the resistance of the elastic member through substitution of a different member and by altering the lengths of the elastic cords 52.

Figure 4:
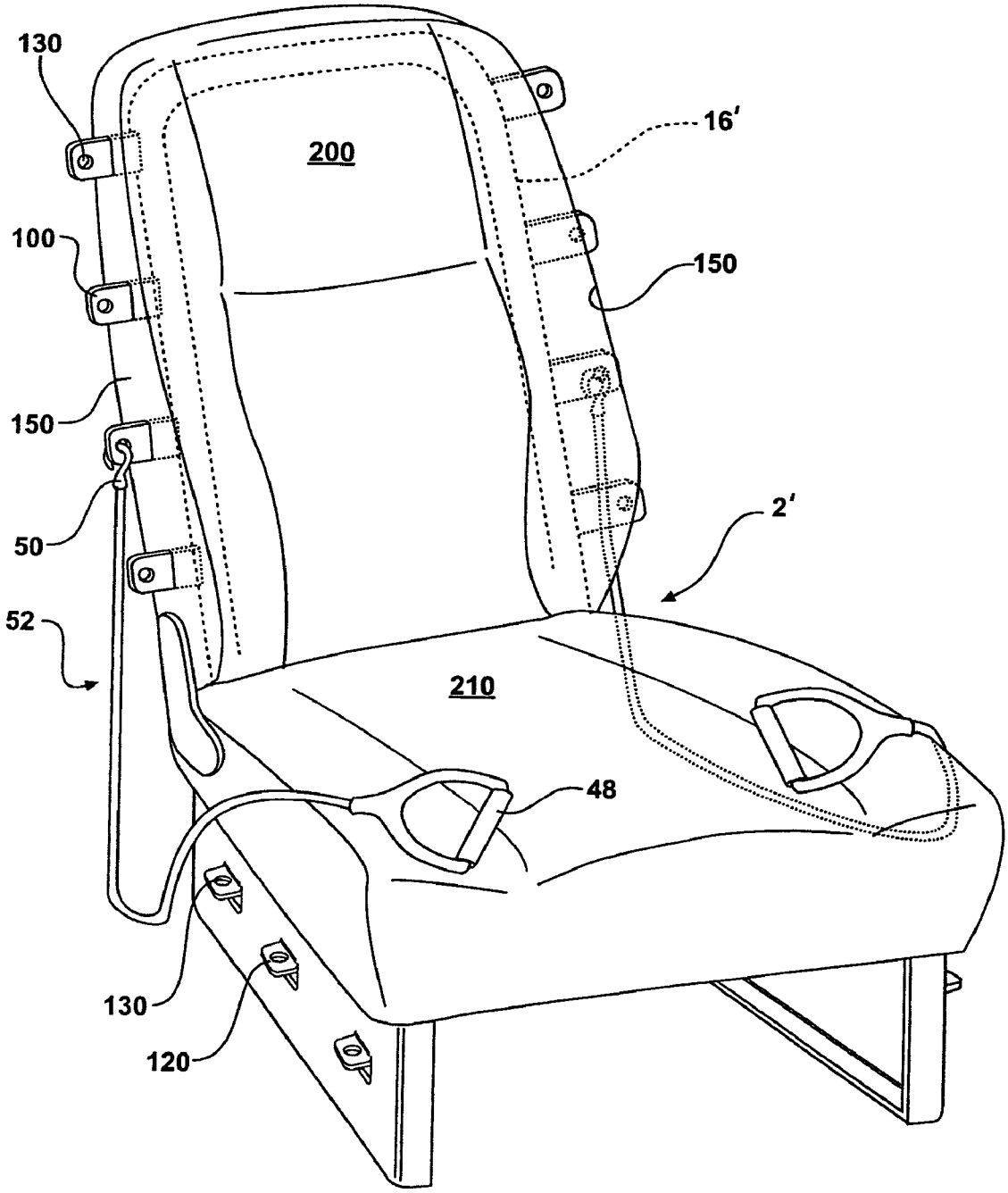
FIG. 4 is a perspective view of an alternative embodiment of the exercise apparatus as according to the invention.

Referring now to FIG. 4, an alternative embodiment 10' of the exercise apparatus for use within a vehicle is illustrated. Preferably, the exercise apparatus 10' includes an exercise device 22 as described above being an elastic cord 52 with opposing ends wherein one end is disposed with a handle 48 and the other end is disposed with a clip 50 or other type of conventional fastener.

Figure 5:
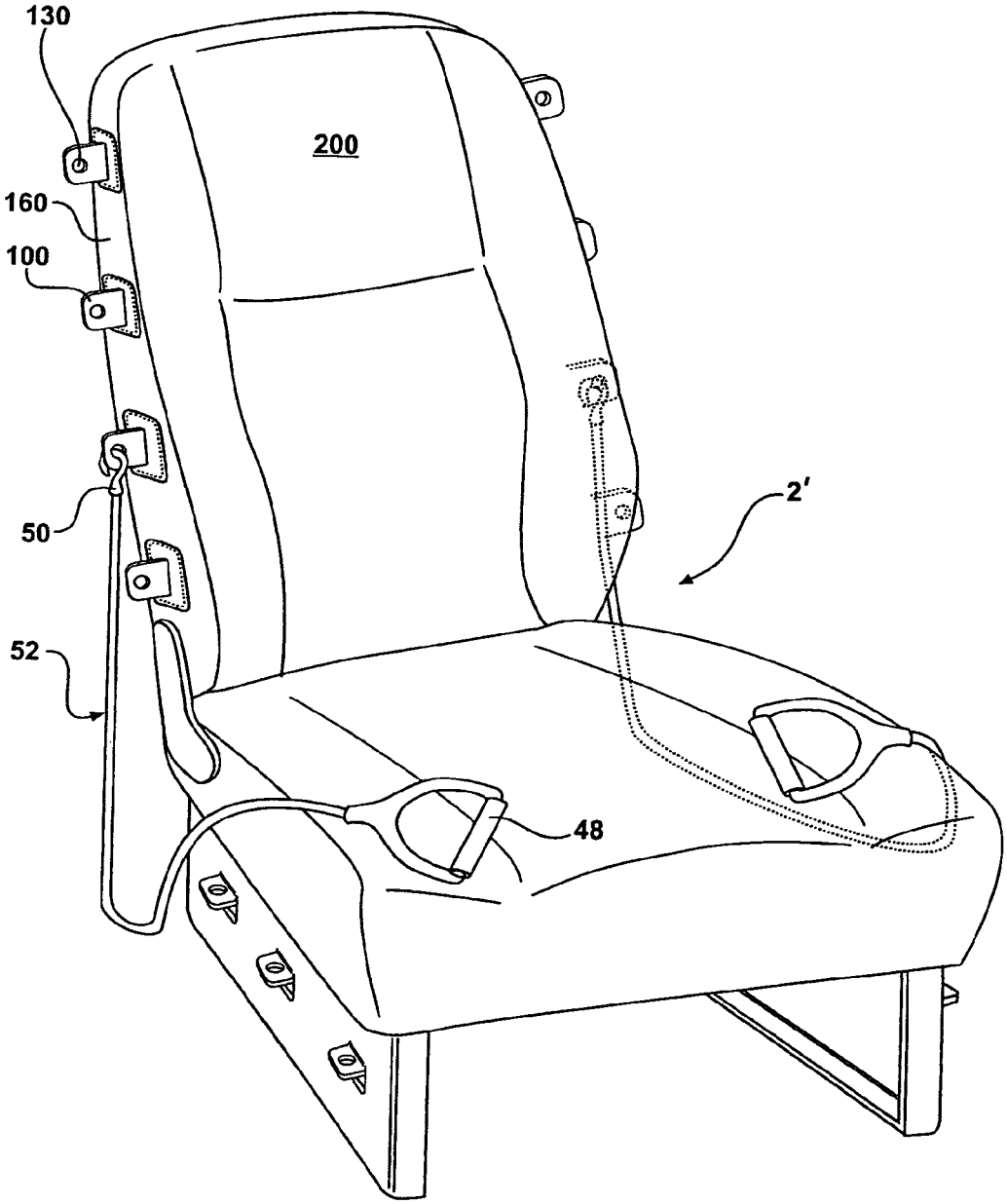
FIG. 5 is a perspective view of the embodiment of FIG. 4 wherein the flanged portions are mounted to a trim piece disposed on the seat back.

In this case, flanged portions 100, 120 extend outwardly from a support frame of the seat on at least one side 150 of the back support 200 and base 210 of the seat, respectively. Preferably, flanged portions are formed at the sides as well as the rear of the seat whereby a user sitting in back thereof may perform exercises by fastening an exercise device 22 thereto. The flanged portions 100, 120 of the seat frame are disposed with a plurality of mounting points or fixtures 130 whereby the clip 50 of the exercise device 22 is made to be selectively attachable thereto. It is appreciated that the mounting points or fixtures 130 may be formed such that various other conventional fastening means may be used for attaching the exercise device 22 to the flanged portions 100, 120. However, the important aspect of the present embodiment is that the support frame of the seat is preformed with flanged portions that allow for the exercise devices 22 to be attached thereto. Thus, vehicle manufacturers may provide the exercise apparatus 10' as a standard or optional feature in selected vehicles. FIG. 5 illustrates the flanged portions 100 extending from a trim piece 160 disposed about the sides of the seat back 200 for accomplishing the alternative embodiment.

Having thus described my invention, various alternative embodiments will become known to those having skill in the art that do not depart from the spirit or scope of the present invention.

We claim:

1. An exercise system for use within a vehicle, comprising in combination:

an exercise device having opposing ends; and a vehicle having a passenger compartment including a floor and a vehicle operator's seat in which the vehicle operator is seated while driving the vehicle, and a passenger seat, at least one of the vehicle operator's or passenger seat including an internal frame, the internal frame being secured directly to the floor of the passenger compartment of the vehicle and having a flange portion, and the exercise device being selectively attachable to the flange portion to allow a user to exercise.

2. The exercise system of claim 1 wherein said flange portion includes a mounting fixture, said exercise device having one end selectively attachable to said mounting fixtures.

3. The exercise system of claim 1 wherein said seat includes a base and a back support, said flange portion extending outwardly from at least one side of at least one of said base and said back support.

4. The exercise system of claim 1 wherein said exercise device is an elastic cord having a grip disposed at one end and a fastener disposed at the other end, said fastener operative to be removably secured to said flange portion.

5. The exercise system of claim 1 wherein said exercise device is a belt having an elastically resilient portion.

6. An exercise system for use within a vehicle, comprising in combination:

an elastic cord having a grip disposed at one end and a fastener disposed at the other end; and a vehicle having a passenger compartment including a floor and a driver's seat, the seat including a frame having a base, and a back support, the back support being mounted around at least a portion of the frame, the base being secured directly to the floor, and the frame having a flange portion, the flange portion extending outwardly from a side of the back support, said fastener being selectively attachable to said flange portion.

7. The exercise system of claim 6 wherein said flange portion includes a mounting fixtures, said fastener being selectively attachable to said mounting fixtures.

8. The exercise system of claim 6 wherein said exercise device is a belt having an elastically resilient portion.

9. An exercise system for use within the operator's cabin of a vehicle, comprising in combination:

an elastic cord having a grip disposed at one end and a fastener disposed at the other end; and a vehicle seat including a back support having a pair of side panels, a base, a frame disposed within the back support, and a pair of legs, the legs being securable directly to the floor of a vehicle, and the seat base and frame being secured to the legs, a plurality of flanged portions extending from each side panel of the back support and from each leg, each flanged portion having a mounting point for attachment of the elastic cord.

10. The exercise system of claim 9 wherein at least one of the flanged portions extending from each side panel comprises a flange have one end secured to the frame disposed with the back support and a second end spaced a distance from an exterior surface of the side panel.

11. The exercise system of claim 9 wherein at least one of the flanged portions extending from each side panel comprises a flange secured to an exterior surface of the side panel.

* * * * *